United States Patent [19]

Merlin

[11] Patent Number: 4,840,291

[45] Date of Patent: Jun. 20, 1989

[54] CONTAINER DISPENSING SYSTEM

[75] Inventor: Dennis Merlin, Thornhill, Canada

[73] Assignee: Hillwell Manufacturing Inc., Ajax, Canada

[21] Appl. No.: 211,717

[22] Filed: Jun. 27, 1988

Related U.S. Application Data

[63] Continuation-in-part of Ser. No. 897,359, Aug. 18, 1986, abandoned.

[51] Int. Cl.[4] ..... B65H 1/08

[52] U.S. Cl. ..... 221/59; 221/63; 221/282; 403/326; 312/43; 312/71

[58] Field of Search ..... 312/42, 43, 45, 61, 312/71; 221/56, 58, 59, 63, 64, 226, 279, 282, 283, 267, 197, 198; 285/401, 306, 376; 403/326, 330

[56] References Cited

U.S. PATENT DOCUMENTS

| | | | |
|---|---|---|---|
| 3,425,406 | 2/1969 | Mejyr | 285/401 |
| 3,672,708 | 6/1972 | Zanberry | 403/326 |
| 3,913,953 | 10/1975 | Archer et al. | 285/401 |
| 4,126,248 | 11/1978 | Houje | 221/279 |
| 4,234,101 | 11/1980 | Pastore | 221/279 |
| 4,372,465 | 2/1983 | Alcorn | 221/279 |

FOREIGN PATENT DOCUMENTS

| | | | |
|---|---|---|---|
| 1290919 | 3/1962 | France | 285/376 |

*Primary Examiner*—H. Grant Skaggs

[57] ABSTRACT

The container dispenser comprises a body member, a collar and a container biasing spring for initially receiving a column of nested containers and continuously exerting a biasing force on the containers, such that the last container of the column is disposed at the open end of the dispensing apparatus. The body member is preferably made of a plastic material formed by extrusion blow molding or injection blow molding and in a further aspect of the invention, the collar is injection molded and secured to the body member by a snap fit or spin weld joining technique. The exterior of the body member is shaped to provide a number of inward depression adjacent the open end of the body member, for engaging the lower most containers of the stack of nested containers. Loading and/or dispensing of containers requires a localized resilient deformation as the containers move past the inward depressions. The body member adjacent the open end also includes a number of outward projections which provide locking lugs on the body member which cooperate with the collar, such that the dispenser can be lockingly maintained in an aperture in a counter or other surface. A separate mounting insert is provided in a modified arrangement for attachment to the counter or other flat surface and by means of which the container dispenser is releasably secured.

8 Claims, 9 Drawing Sheets

12
3
2
10
38
34
40
42
30
14
36
16
45
30
44
28
6
4
32
150

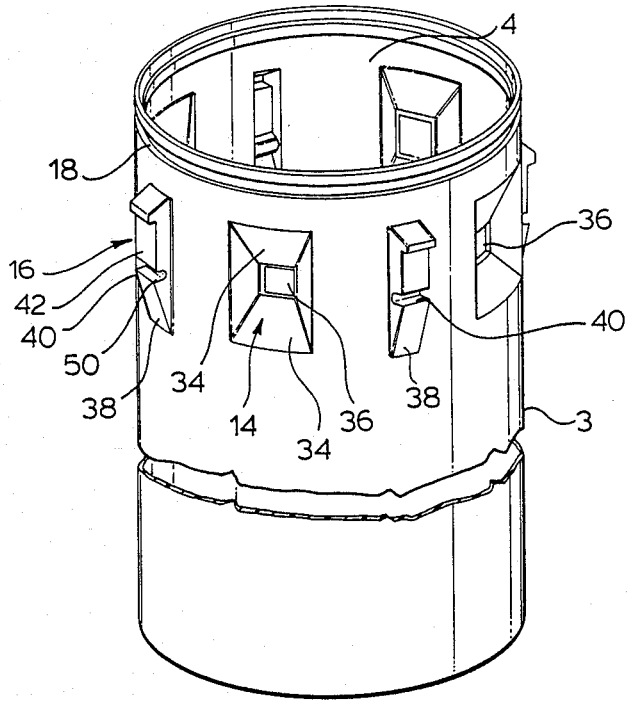
FIG. 7.
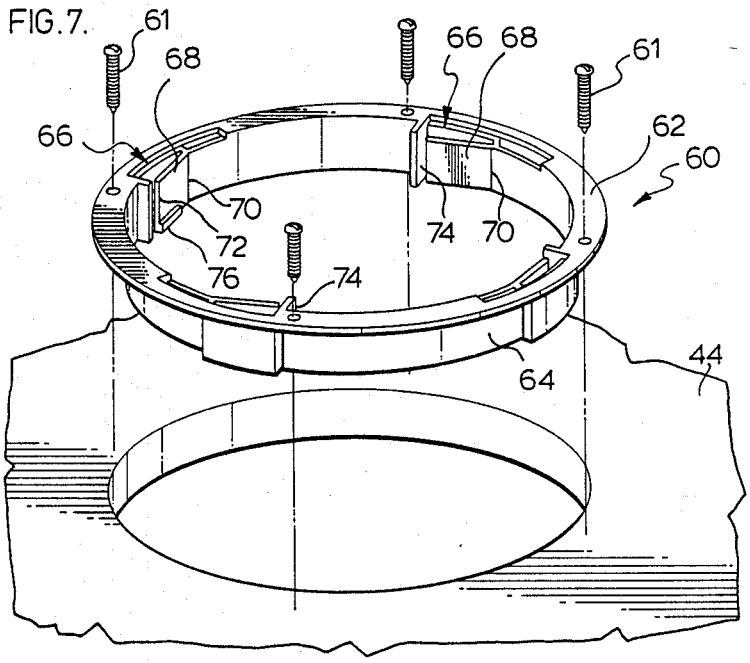

CONTAINER DISPENSING SYSTEM

This application is a continuation-in-part of U.S. application Ser. No. 897,359 filed Aug. 18, 1986, now abandoned.

BACKGROUND OF THE INVENTION

Plastic containers have gained wide acceptance in the fast food industry, and many arrangements have been proposed for conveniently dispensing of a container by withdrawing the last cup from the column of cups appropriately supported in that dispenser. Typically and perhaps the most popular of container dispensers are cup dispensers, which include a tubular-like body member of a stainless or other metal, which provide a housing for a stack of nest containers. The body member includes a cup biasing means at one end thereof and an open end through which containers are loaded and dispensed. The open end includes a metal collar arrangement with flat metal separate fingers secured to the collar. These spring fingers releasably retain containers in the body and the fingers are secured by any suitable means such as spot welding. Other metal spring fingers are secured to the outside of the body used to secure the dispenser in a counter or wall. Conatiner dispensers of this type work satisfactorily, however, the cost for the same and the amount of skill in the manufacture thereof render them expensive to produce.

The present inventor advantageously used the low cost capabilities of flow molding extrusions, where outside tolerances can be fairly well maintained, in forming of at least the body member of the dispenser. The blow molding extrusion operation greatly simplifies the formation of deformations for maintaining the containers or cups in the dispenser, as well as conveniently allows the forming of stop faces used to retain the dispenser in a counter.

According to an aspect of the invention, the collar of the dispenser is also made of a plastic material and made by injection molding. The collar has a snap ring associated with an interior portion of the collar, which cooperates with a snap recess in the exterior of the body member adjacent the open end thereof. The parts are then snapped together and the biasing means may be inserted in the body member to complete the assembly operation.

According to a further aspect of the invention, a mounting insert is provided for reception in a counter or other flat surface by means of which the container dispenser is secured.

In a container dispensing system according to the present invention, a mounting insert for reception in a flat surface is used to receive a container dispenser. The mounting insert comprises a seating flange having a downwardly extending tubular locating inset at the interior of the seating flange.

This tubular locating inset has a plurality of recesses spaced thereabout with spring fingers disposed therein and extending inwardly at a shallow angle past the tubular locating inset. Each finger is connected to a generally vertical edge of one of the recesses with an opposite end of said finger being free and movable into the associated recess.

Each recess includes an inwardly extending vertical stop face adjacent said free end of the finger for providing a rotational stop for the dispenser.

The present invention is also directed to the combination of a container dispenser and a mounting insert. The container dispenser comprises a one piece tubular-like body of a plastic material having an open end and a generally closed end, a collar means applied to the open end and extending outwardly to define a flat surface engaging member about the open end. A biasing means interior to the body urges containers to the open end of the body.

The body at the open end thereof includes a plurality of inward container engaging deformations integral with the body, and a plurality of outward deformations each having an inwardly extending slot region.

The collar means is secured to the body adjacent the open end of the body and providing a mouth through which containers can be dispensed.

The mounting insert comprises a seating flange having a downwardly extending tubular locating inset at the interior of the circular seating flange.

The tubular locating inset has a number of recesses spaced thereabout with spring fingers disposed therein and extending inwardly at a shallow angle past said tubular locating inset, each finger being connected to a generally vertical edge of one of the recesses with an opposite end of the finger being free.

Each recess includes an inwardly extending vertical stop face adjacent the free end of the finger.

The tubular locating inset is sized to receive the tubular like body with the spring fingers being engagable with the slot regions of the outward deformations when the body is appropriately received in the insert to exert a gripping force thereon with the stop faces of the insert engaging a side portion of the outward deformations to limit the extent of rotation of the dispenser relative to the insert.

BRIEF DESCRIPTION OF THE DRAWINGS

Preferred embodiments of the invention are shown in the drawings wherein;

FIG. 7 is a perspective view of the body of the dispenser about to be inserted and secured in the mounting insert;

DETAILED DESCRIPTION OF THE PREFERRED EMBODIMENTS

Figure 1:
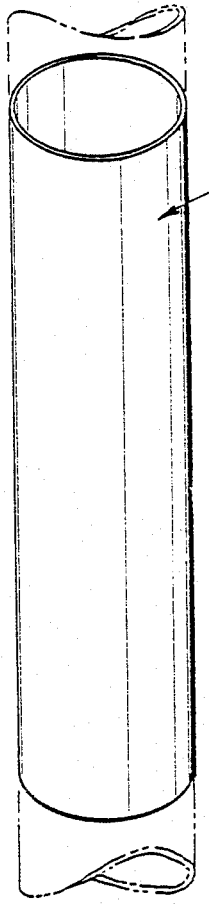
FIG. 1 shows a schematic of the production process used for forming of the body member.
Figure 1A:
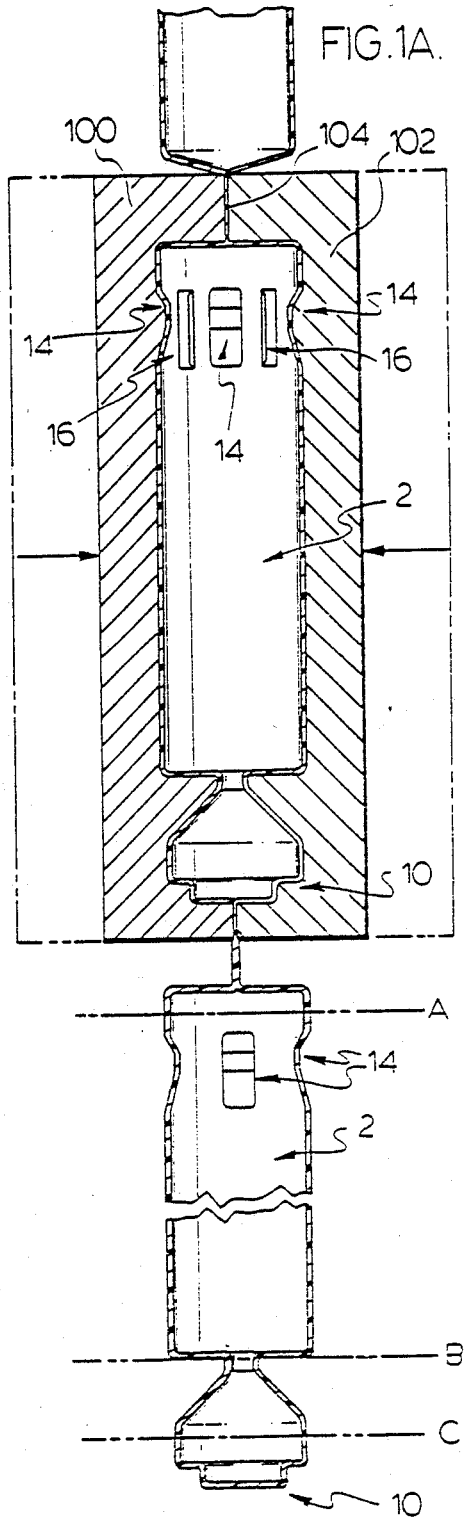
Figure 2:
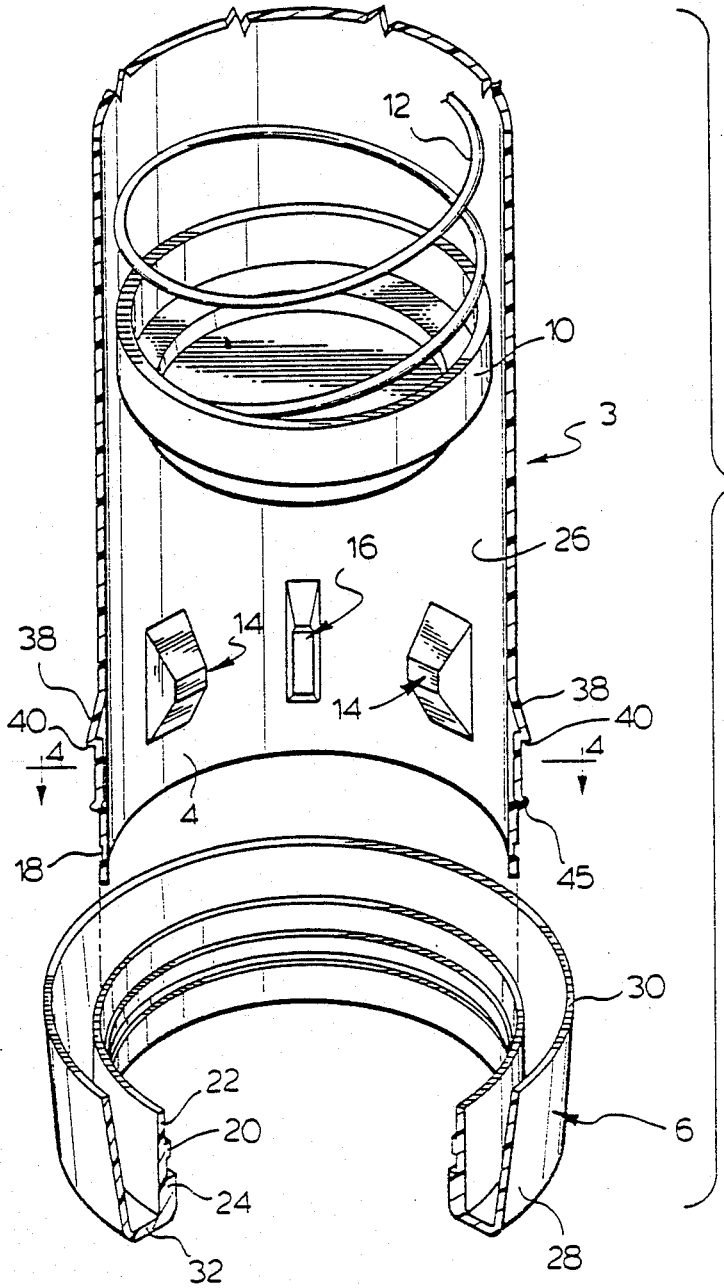
FIG. 2 is a partial exploded view of the container dispenser.

The combination extrusion blow molding technique is generally shown in FIG. 1, where a length of extruded hot plastic pipe is generally shown as 1 with shaping dies 100 and 102 being clamped thereabout for forming of the exterior shape of the body member 2 and the exterior shape of the container engaging cup 10. After forming of the exterior shape, the formed product is removed from dies 100 and 102 and proceeds to a trimming operation where the product of the forming operation is trimmed along lines A, B and C in FIG. 1. This then produces the body member generally shown as 3 in FIG. 2 and the container engaging cup 10 shown in FIG. 2. The blow molding technique requires a pressurized gas which is introduced through the passage generally shown as 104 and the pressurized gas forces the tube against the die members 100 and 102. The combination extrusion blow molding operation is of the conventional type, however, it has been adapted for forming of two parts of the container dispensing arrangement in a single forming operation.

Figure 3:
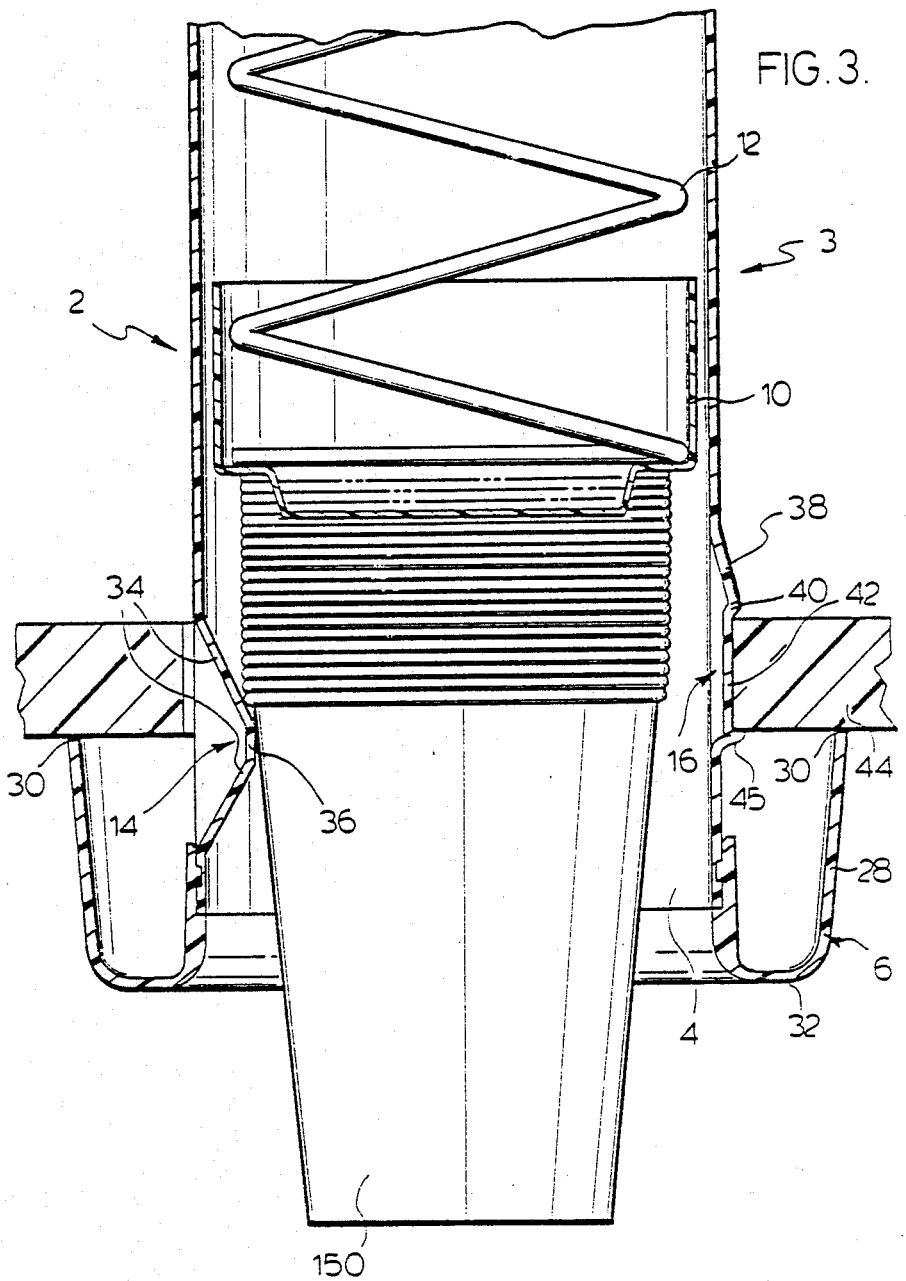
FIG. 3 is a partial cut-away view of the dispenser showing a number of cups disposed therein.

The container dispenser 2, requires a shaped body member 3 having a number of inwardly extending depressions 14 which provide a stop face for engaging the rims of cups as generally shown in FIG. 3. These depressions have tapered faces 34, one of which acts as a cup engaging surface and the taper of the depression generally opens to the exterior of the body. The open end 4 of the body member 3 has a snap ring recess 18 in the exterior surface thereof which is accurately formed as it is part of the exterior surface of the body member. This snap ring recess 18 cooperates with snap ring 20 provided on the interior surface of the collar 6, with the stepped interior wall 22 of the collar cooperating with the exterior of the body member 3 to provide positive securement of the collar 6 to the body member 3. In addition, the collar 6 has been provided with an inwardly extending lip 24 which cooperates with the thickness of the body member such that a relatively smooth interior surface is provided at the mouth of the dispenser as generally shown in FIG. 3.

The collar 6 and the body member 3 can be modified whereby they are secured by a spin welding technique. In this case, cooperating overlapping securing faces would be provided between the collar and body shaped for this securing technique. Such an arrangement has some cost advantages compared to the snap ring described above.

A number of locking lugs 16 have been provided about the exterior of the body member generally adjacent the open end 4 thereof, which are sized to provide a contacting face 42 for engaging the aperture through a support surface such as counter 44 shown in FIG. 3. Stop faces 40 are provided for holding the body member to one side of the counter 44 which cooperate with stop face 45 on the other side of the counter. Stop face 40 cooperates with contacting face 30 of the collar member 6 to provide a snug fit of the dispensing apparatus 2 in the counter 44 and the outer ring 28 of the collar has a slight taper thereon to permit some bowing to enhance the resilient action between stop face 40 and the collar and thereby maintain the snug fit of the dispenser within the counter. This snug fit keeps a spring bias urging the collar into contact with the counter and reduces contamination by dirt etc. Stop faces 45 cooperate with the collar to assure the body remains in place and does not pass through the support surface.

Thus the container dispenser 2 can essentially be entirely of a plastic material with collar 6 being injection molded and body member 3 and container engaging cup 10 formed during a blow molding operation. The coil spring biasing means 12 is the exception and is preferrably of a metal. The spring biasing means 12 cooperates with the closed end 5 of the body member 2, to constantly urge the cups to the open end of the container dispenser.

The locking relationship of the collar with the body member 3, advantageously uses the accurate exterior surface of the body member in cooperation with the fairly accurate surfaces formed during the injection molding of the collar 6. In blow molding extrusions, the interior tolerances of the body member are less accurate, however, they are sufficient for the present application where the surfaces requiring accuracy are exterior surfaces.

Figure 5:
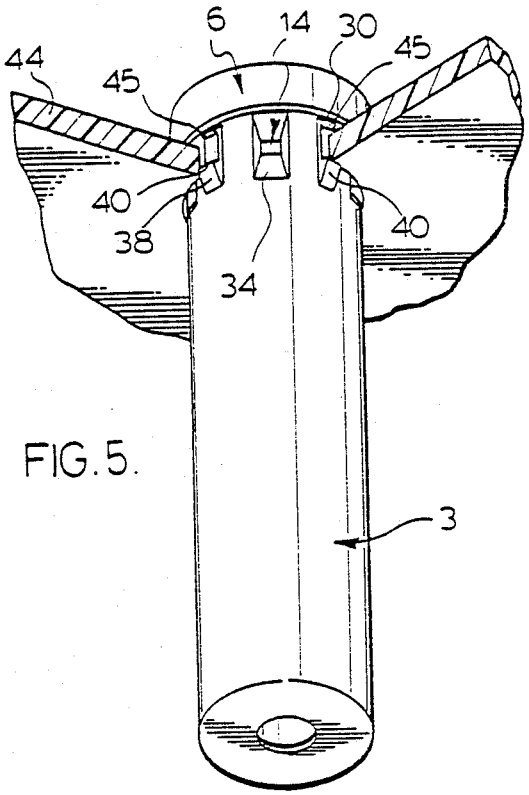
FIG. 5 is a perspective view of a cutaway of a counter showing the dispenser located therein.
Figure 4:
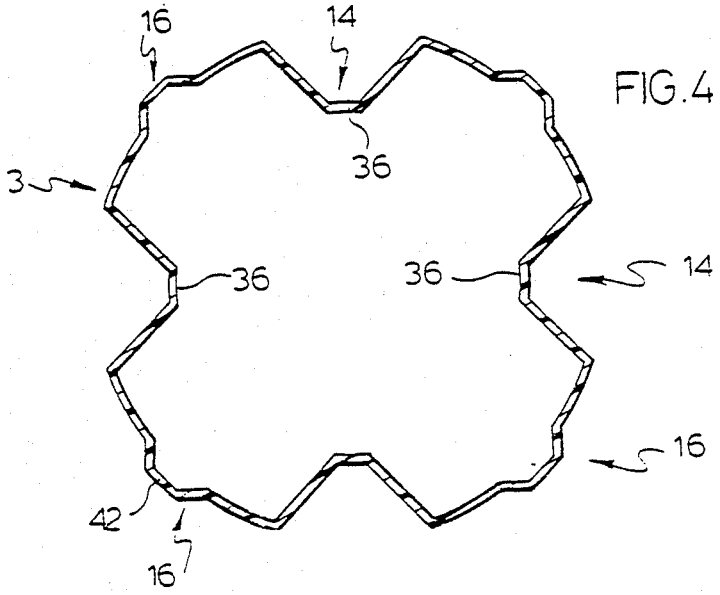
FIG. 4 is a sectional view taken along lines 4—4 of FIG. 2.

As shown in FIG. 3, the containers 150 in this case in the form of a column of nested cups, are held in the dispenser between the inward projections 14 and the container engaging cup 10. A container in withdrawn from the dispenser by pulling on the exposed surface thereof, which results in a minor deformation of the container, of a magnitude sufficient to allow the container to move past the inward projections 14. The next to be dispensed container of the remaining nested containers is then urged into contact with the inward projection under the influence of the spring bias. This dispenser is often mounted in the manner of FIG. 5, with the dispenser mounted in a horizontal counter, whereby cups are urged upwardly by the biasing means, however, they can be also mounted in a horizontal surface in the manner of FIG. 3, where gravity also urges the containers towards the open end of the dispenser or in a vertical or other generally planar surface.

A modified version of the invention is shown in FIGS. 6 through 12 wherein a mounting insert 60 is used in combination with the container dispenser 2 previously described where the mounting insert provides a precise component which can be secured in a counter and provide positive retension of the container dispenser relative to the mounting insert. This arrangement overcomes problems in precisely sizing the cutout in a counter as the insert is directly secured to the counter and securement is between the insert and the dispenser body.

The mounting insert 60 includes a circular seating flange 62 having at an interior edge region a tubular locating inset 64. This tubular locating inset is placed in the cutout within the flat surface, such as a counter or wall, and provides a cooperating surface for engaging the body member 3 of the container dispenser 2. The tubular locating inset 64 includes recesses 66 have associated therewith spring fingers 68 extending at a shallow angle inwardly and each are secured at one end to the vertical edge 70 of the associated recess. This forms a connection of the spring fingers to the mounting insert where the free end of each spring finger 68 is able to move into the recess and is positioned inwardly of the locating inset to contact with the locking lugs 16 formed as outer projections of the body member 3.

Engagement of the mounting insert 60 with the container dispenser 2 is shown in FIGS. 8 through 12 where each of the spring fingers 68 engage one of the locking lugs 16 due to rotation of the container body once generally located within the mounting insert 60. The fact that the spring fingers initially extend inwardly at a shallow angle (FIGS. 9 and 12) is not a problem, as engagement between the body member 3 and the mounting insert 60 is accomplished by an axial rotation of the body member which brings the locking lugs 16 into contact with the spring fingers 68.

Figure 9:
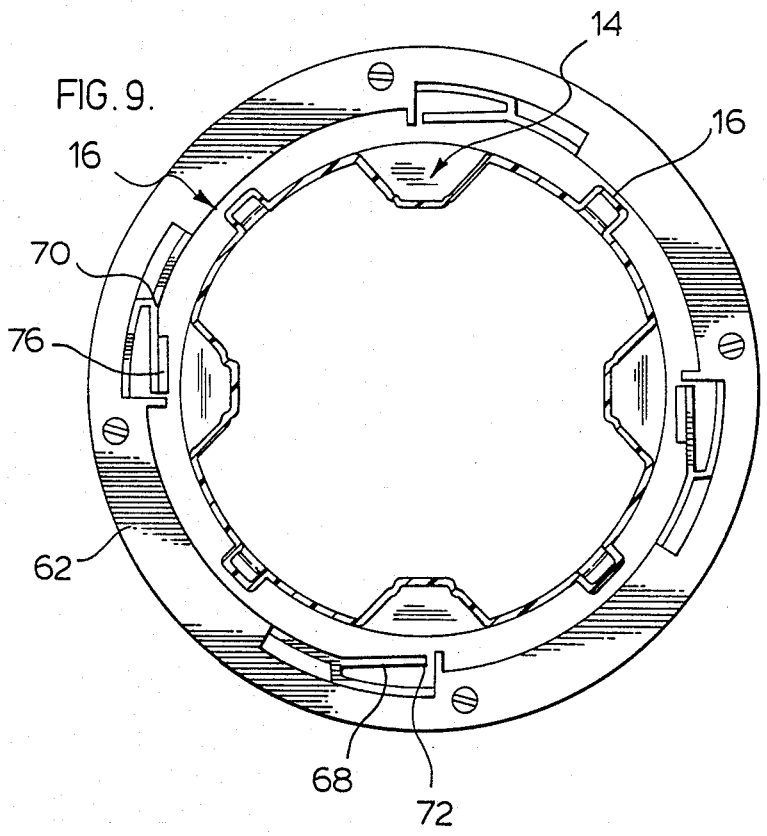
FIGS. 9 and 11 are sectional views showing cooperation of the dispensing body and the mounting insert.
Figure 10:
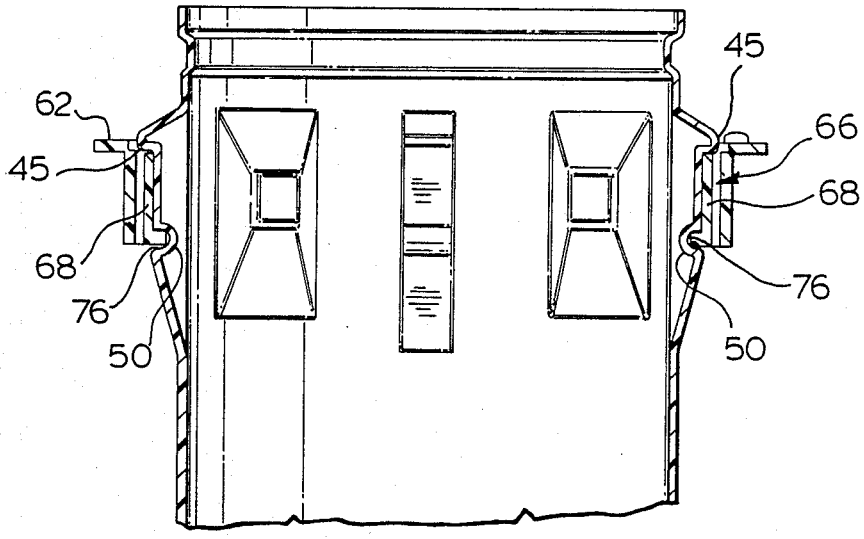
FIG. 10 is a vertical section showing the mounting insert engaging the dispensing body.

Installation of the body 3 of the container dispensing system 2 in the modified form of FIGS. 6 through 12 can be appreciated from a review of FIGS. 7 through 11. Initially, the mounting insert 60 is separately secured to a flat surface 44 by any suitable means such as the screws 61 which pass through holes in the circular seating flange 62 and engage the counter 44. The body 3, with or without the collar 6, is then inserted into the insert in the manner generally shown in FIG. 9 where the locking lugs 16 are spaced from the recesses 66. The collar 6 will serve to generally appropriately locate the locking lugs 16 at the level of the spring fingers 68 as generally shown in FIG. 10. Once the body of the container has been so located, it is then rotated in the direction indicated in FIG. 11, bring each of the locking lugs 16 into engagement with the spring fingers 68. The final position of the body relative to the spring fingers is defined by the engagement of the stop faces 74 with the vertical side faces of the locking lugs 16. Thus, the side of the locking lug will strike the inwardly extending stop face 74, thereby restricting further rotation which would otherwise take the locking lug out of contact with the spring finger. A number of the spring fingers include a horizontal locking ridge 76 which is received within the locking slot 50 of the locking lug 16 with stop face 74 in contact with the upper surface of the leaf spring as generally shown in the vertical sections. Thus, any attempt to axially withdraw the body member 3 from the mounting insert 60 is opposed due to the interference of horizontal locking ridge 76 and the recess 50. In the preferred embodiment, only two of the spring fingers 68 include these locking ridges as generally shown in FIG. 9. It has been found that two are sufficient, however, it can be appreciated that all of the spring fingers could be provided with the same, if desired. All of the locking lugs 16 have been provided with the appropriate recess 50 to avoid the necessity to pair locking lugs with spring fingers.

The collar 6, due to contact with the flat surface beyond the inset, generally horizontally positions the locking lugs 16 whereby rotation of the container body 3 brings the locking lugs 16 into engagement with the spring fingers 68. Each of these locking lugs 16 includes a recess portion for reception of the spring fingers, and the spring fingers also serve to appropriately locate the body member relative to its vertical position.

The relationship of the mounting insert 60 and the collar 6 are such to effect a cooperation whereby the collar is drawn under a slight bias into engagement with the surface 44 when the locking lugs are appropriately engaged by their spring fingers 68. As the mounting insert is separate and apart from the depth of the counter, this particular relationship can be assured, whereas with the embodiment of FIGS. 1 through 5, the connection is dependent upon the depth of the flat surface 44. Furthermore, this modified version prevents inadvertent withdrawal of the entire dispensing unit, as a rotational movement is required to release the container body from the mounting insert.

Figure 6:
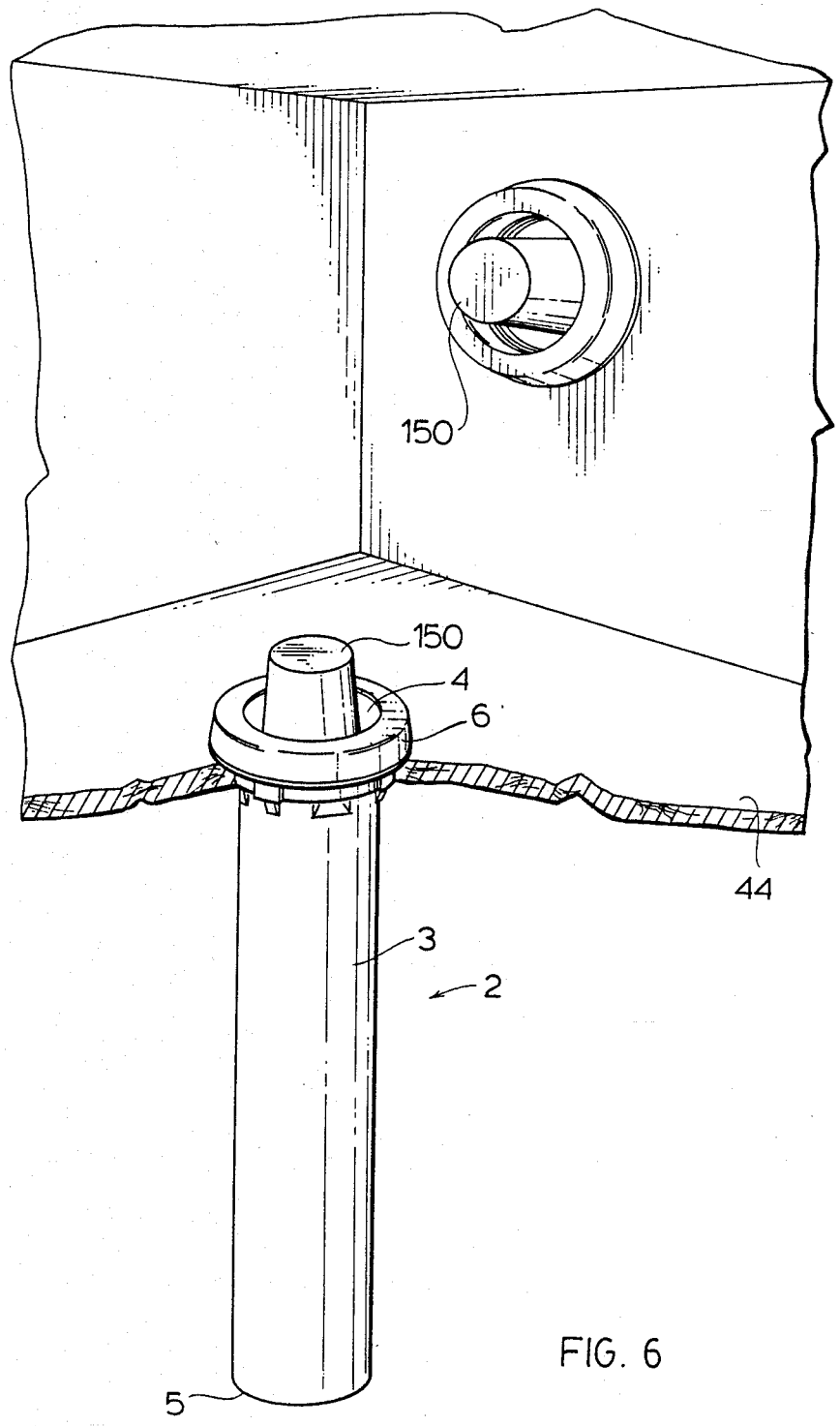
FIG. 6 is a perspective partial cutaway view illustrating mounting of a modified dispensing system.
Figure 8:
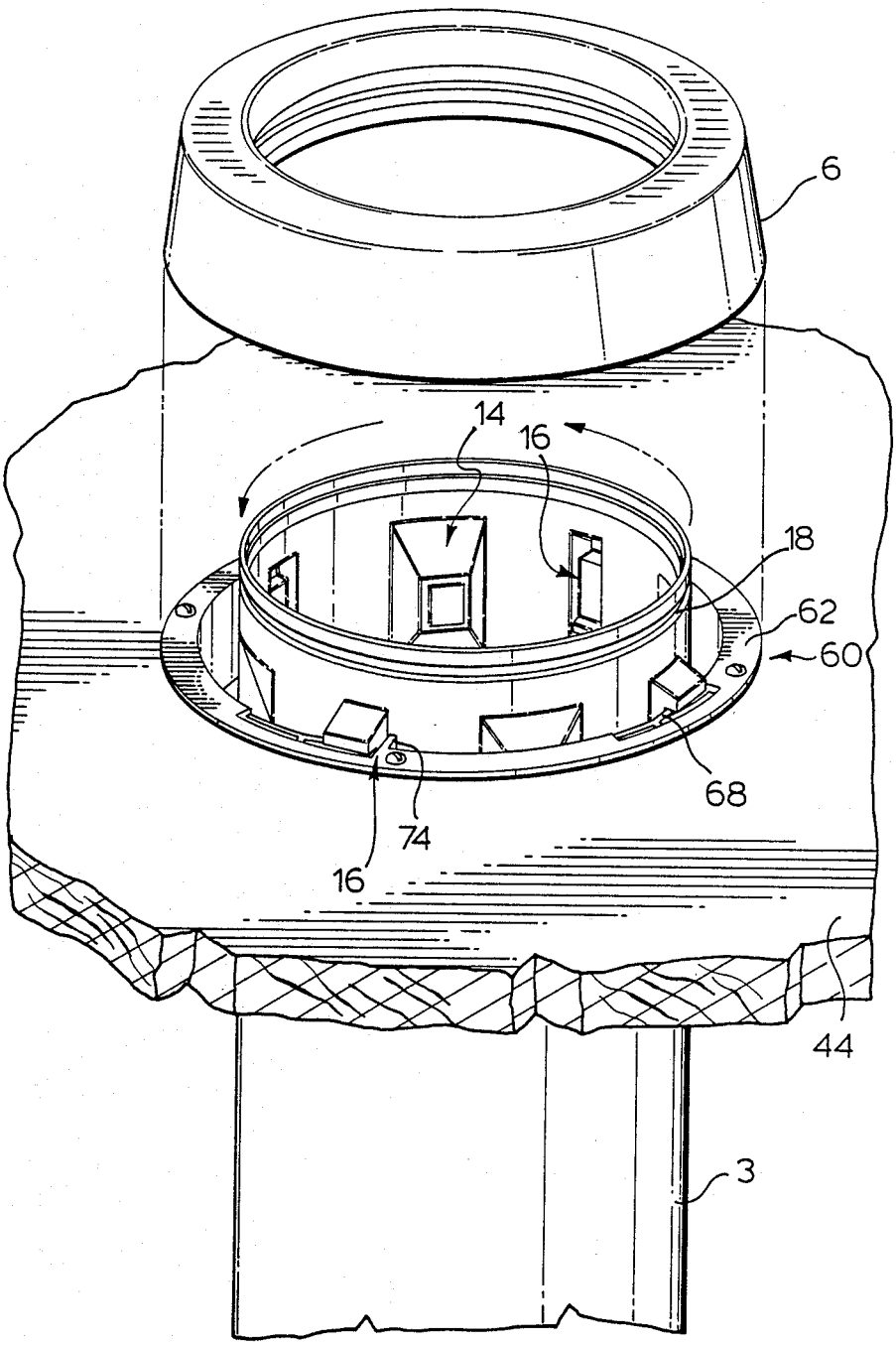
FIG. 8 illustrates securement of the modified system.
Figure 12:
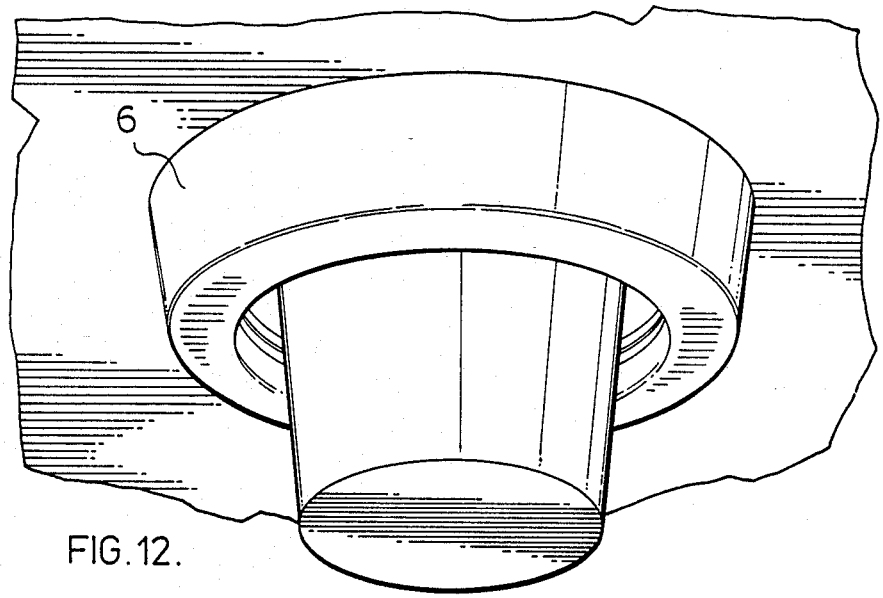
FIG. 12 is a perspective view of the dispensing system suspended below a horizontal mounting surface.
Figure 11:
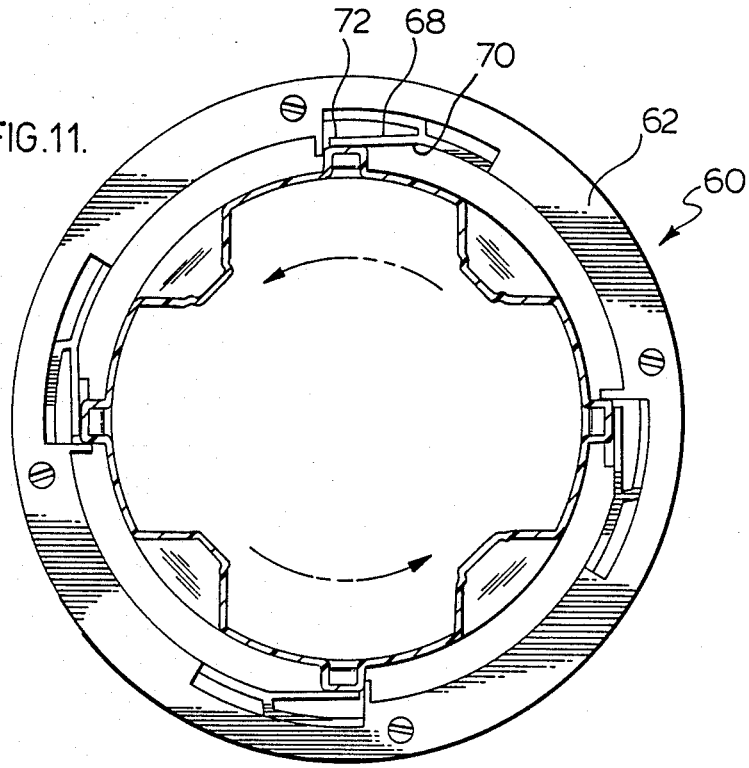

As clearly illustrated in FIGS. 6 and 12, the dispensing system can be installed in a horizontal surface as illustrated in FIG. 6, a vertical surface as indicated in FIG. 6, or the dispensing unit may be suspended from a horizontal surface as indicated in FIG. 12. This particular overlapping locking arrangement simplifies installation and assures the positive fit of the dispensing system in a flat surface. It can also be appreciated that the precision with respect to defining the cutout in the counter surface has been reduced and damage caused by contact of the body member 3 with the raw edge of the cut counter has been eliminated by means of the mounting insert 60 having the tubular locating inset 62.

It has been found that the blow molding technique for defining the locking lug 16 is sufficiently accurate when it is used in combination with the injection molded mounting insert 60 and the injection molded collar 6. It should also be noted that the shape of the collar, having a channel with one edge of the channel engaging about the mounting insert 60 and enclosing the same, allows this outer portion of the collar to deflect somewhat and cooperate with the spring fingers in drawing the collar into close contact with the surface 44.

It has been found that although the container dispenser can be satisfactorily inserted within a circular aperture in a countertop, the surface material of the countertop is somewhat difficult to cut and can result in abrasive edges which tend to cut the body 3 of the container dispenser 2 when it is forced into engagement with the counter. Furthermore, the engagement without the mounting insert 60 is basically a friction fit and inadvertent turning of the dispenser can further damage the body member 3.

By using the mounting insert 60, positive retension of the dispenser is provided which does not rely on a frictional engagement, but relies on interference of various parts which are brought into a locking relationship due to rotation of the dispenser relative to the mounting insert. This rotation of the body is protected from damage of the surrounding environment due to the tubular locating inset 64 which acts as a partial sleeve about the body member 3.

This relationship is advantageous as the dispenser body can easily be removed for cleaning or cleaning of the counter about the dispenser whereafter the dispenser body is easily reinstalled. As the connection is defined by parts of the system, they are designed for repeated connection, and damage to the parts does not occur by this operation.

The mounting insert 60 is injected molded of a plastic material such as acetal or other suitable crystaline resins which have suitable properties with respect to resilient deformation and toughness to render it suitable for this application where the spring fingers exert constant pressure on a secured body member. Both the mounting insert and the container dispenser 2 are made of a plastic material which is easily cleaned and is appropriate for the environment of a container dispenser in a high volume outlet where wear occurs not only due to use, but due to constant cleaning. It was previously believed that stainless steel was most suitable for this application, however; after continued cleaning, the stainless steel does tend to dull and become somewhat coloured and as such, has not been entirely satisfactory. Furthermore, the use of metal dispensing systems tends to be expensive and do not rely on the snap fit type arrangements of the various components of the present system.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In a container dispensing system, a mounting insert for reception in a flat surface, said mounting insert comprising:

a seating flange having a downwardly extending tubular locating inset at the interior of the seating flange, said tubular locating inset having a plurality of recesses spaced thereabout with spring fingers disposed therein and extending inwardly at a shallow angle past said tubular locating inset, each finger being connected to a generally vertical edge of one of said recesses with an opposite end of said finger being free and movable into the associated recess, each recess including an inwardly extending vertical stop face adjacent said free end of said finger.

2. In a container dispensing system as claimed in claim 1 wherein said tubular locating inset extends at least about one half of an inch below said seating flange.

3. In a container dispensing system as claimed in claim 2 wherein said spring fingers are of a depth generally corresponding to the depth of said tubular locating inset.

4. In a container dispensing system as claimed in claim 3 wherein there are four recesses symmetrically disposed about the tubular locating inset with each recess having a spring finger partially disposed therein and movable into said recess.

5. In combination a container dispenser and a mounting insert, said container dispenser comprising:

a one piece tubular-like body of a plastic material and having an open end and a generally closed end, a collar means applied to said open end and extending outwardly to define a flat surface engaging member about said open end, and biasing means interior to said body for urging containers to one end of said body, said body at the open end thereof including a plurality of inward container engaging deformations integral with said body, and a plurality of outward deformations each having an inwardly extending slot region, said collar means being secured to said body adjacent the open end of said body and providing a mouth for said dispenser through which containers can be dispensed;

said mounting insert comprising:

a seating flange having a downwardly extending tubular locating inset at the interior of the circular seating flange, said tubular locating inset having a number of recesses spaced thereabout with spring fingers disposed therein and extending inwardly at a shallow angle past said tubular locating inset, each finger being connected to a generally vertical edge of one of said recesses with an opposite end of said finger being free, each recess including an inwardly extending vertical stop face adjacent said free end of said finger;

said tubular locating inset being sized to receive said tubular like body with said spring fingers being engagable with said slot regions of said outward deformations when said body is appropriately received in said insert to exert a gripping force thereon with said stop faces of said insert engaging a side portion of said outward deformations to limit the extent of rotation of said dispenser relative to said insert.

6. In combination as claimed in claim 5 wherein each spring finger includes one part of a two part horizontal locking arrangement with the other part found on a portion of said outward deformation which is contacted by a spring finger, said horizontal locking arrangement providing a bias to maintain the spring fingers in gripping engagement with said outward deformations.

7. In combination as claimed in claim 6 wherein said horizontal locking arrangement has a projecting ridge on at least two of said spring fingers and horizontal groove regions provided in all of said slotted regions of outward deformations for receiving said projecting ridge.

8. In combination as claimed in claim 5 wherein said slotted regions and said spring fingers cooperate to produce a bias urging said collar into pressure engagement with a flat surface about said mounting insert and into which said mounting insert is secured.

* * * * *